US008496495B2

(12) United States Patent
Kari

(10) Patent No.: US 8,496,495 B2
(45) Date of Patent: Jul. 30, 2013

(54) COAXIAL CONNECTOR WITH COUPLING SPRING

(75) Inventor: Thomas Kari, Waseca, MN (US)

(73) Assignee: Emerson Network Power Connectivity Solutions, Inc., Bannockburn, IL (US)

( * ) Notice: Subject to any disclaimer, the term of this patent is extended or adjusted under 35 U.S.C. 154(b) by 44 days.

(21) Appl. No.: 12/800,899

(22) Filed: May 25, 2010

(65) Prior Publication Data

US 2010/0304598 A1 Dec. 2, 2010

Related U.S. Application Data

(60) Provisional application No. 61/217,551, filed on Jun. 1, 2009.

(51) Int. Cl.
*H01R 13/627* (2006.01)

(52) U.S. Cl.
USPC ..... 439/352; 439/578

(58) Field of Classification Search
USPC ..... 439/352, 355, 578
See application file for complete search history.

(56) References Cited

U.S. PATENT DOCUMENTS

| | | | | |
|---|---|---|---|---|
| 6,645,011 | B2 | 11/2003 | Schneider et al. | |
| 6,692,286 | B1 | 2/2004 | De Cet | |
| 7,329,139 | B2 * | 2/2008 | Benham | 439/352 |
| 7,351,088 | B1 | 4/2008 | Qu | |
| 7,722,379 | B2 * | 5/2010 | Yang et al. | 439/352 |
| 7,785,129 | B2 * | 8/2010 | Chen | 439/352 |
| 7,806,714 | B2 * | 10/2010 | Williams et al. | 439/352 |
| 7,857,651 | B2 * | 12/2010 | Chen | 439/352 |
| 8,021,181 | B2 * | 9/2011 | Montena et al. | 439/352 |

* cited by examiner

*Primary Examiner* — Hien Vu
(74) *Attorney, Agent, or Firm* — Karl D. Kovach

(57) ABSTRACT

The device includes an inner conductor, a dielectric material, an outer conductor, a coupling spring, and a sliding sleeve. The dielectric material surrounds the inner conductor. The outer conductor surrounds the dielectric material. The sliding sleeve is slidably attached to the outer conductor. The coupling spring is attached to the outer conductor. The coupling spring includes a plurality of beam tines. Each beam tine includes a lever tine. An adjacent pair of beam tines is separated by a slot where the slot has a root. A first distance is defined from the root to an edge of the beam tine. A second length is defined from the root to a distal end of the lever tine. The first length is greater than the second length.

10 Claims, 4 Drawing Sheets

COAXIAL CONNECTOR WITH COUPLING SPRING

This non-provisional application claims the priority of earlier filed U.S. Provisional Application Ser. No. 61/217,551, filed Jun. 1, 2009. U.S. Provisional Application Ser. No. 61/217,551, is hereby incorporated herein by reference.

BACKGROUND OF THE INVENTION

1. Field of the Invention

The present invention pertains to coaxial connectors. The invention more particularly concerns a male coaxial connector which includes a coupling spring where, when the male coaxial connector is mated to a female coaxial connector, the coupling spring reduces signal noise caused by misalignment between the male coaxial connector and the female coaxial connector.

2. Discussion of the Background

Coaxial cable is used extensively in cable television system distribution networks as well as in other industries in which signal transmission is important. Coaxial connectors are used to terminate the ends of coaxial cable, and coaxial connectors are used on devices and components so as to be able to interconnect with each other via the coaxial cables.

Coaxial connectors are known in the art. Typically, an interconnection between two coaxial cables or between a coaxial cable and a device or component is made between a male coaxial connector and a female coaxial connector. As the signal propagates along the coaxial cable and proceeds through the interconnection of the male coaxial connector and the female coaxial connector, so as to be introduced into another coaxial cable or into a device or component, the interconnection provides opportunities for the signal to become distorted or corrupted or diminished in power due to the physical construction and orientation of the interconnected male and female coaxial connectors. A distorted signal is most prevalent when the interconnection between the male coaxial connector and the female coaxial connector is subjected to a tangential external force which causes the two connectors to become misaligned relative to one another so that their respective longitudinal axes are no longer substantially collinear.

One related art coaxial connector is shown in FIG. 1. FIG. 1 is taken from FIG. 3 of U.S. Pat. No. 6,692,286. An axial coupling force is generated in this embodiment when a spring tine having a fixed bead or locking lug 38, but which is identified with reference numeral eight in U.S. Pat. No. 6,692,286, comes into contact with, and slides against, an inclined plane or clamping surface 43, but which is identified with reference numeral thirteen in U.S. Pat. No. 6,692,286, and generates an axial force component and a radial force component. Since the fixed bead 38 is located on one connector 32 and the inclined plane 43 is located on the second connector 33, the axial force causes the two connectors 32, 33 to be urged towards one another. When the mated connectors 32, 33 are subjected to severe environmental forces or external forces, the mating planes of the connectors may slightly separate and the fixed bead or locking lug 38 may slide up the inclined plane 43 thus causing electrical signal noise. U.S. Pat. No. 6,692,286 is hereby incorporated herein by reference.

A second related art coaxial connector is shown in FIG. 2. FIG. 2 is taken from FIG. 1 of U.S. Pat. No. 7,351,088. An axial coupling force is generated in this embodiment when a spring or locking sheet 48, having teeth, of one connector 52 comes into contact with a down-slope or inclined plane 44 of a second connector 53 and as such generates an axial force so as to urge connectors 52 and 53 towards each other. The tangential angle of the spring 48 relative to the inclined plane 44 and the length of the spring 48, which appears to be very short, could cause permanent plastic deformation of the tine of the spring 48 when the tine of the spring 48 is deflected. In U.S. Pat. No. 7,351,088, the locking sheet 48 is identified by reference numeral eight, and the inclined plane 44 is identified by reference numeral fourteen. U.S. Pat. No. 7,351,088 is hereby incorporated herein by reference.

A third related art coaxial connector is shown in FIG. 3. FIG. 3 is taken from FIG. 1 of U.S. Pat. No. 6,645,011. An axial coupling force is generated when a split ring or C-shaped spring 55 of one connector 62 acts against a frustoconical bearing surface or inclined plane 60 of another connector 63. A rim 56 of the split ring 55 acts against the inclined surface 60. The rim 56 acts as a fixed bead similar to the fixed bead described above in regard to U.S. Pat. No. 6,692,286. In U.S. Pat. No. 6,645,011, the split ring 55 is identified by reference numeral twenty-five, the inclined plane 60 is identified by reference numeral forty, and the rim 56 is identified by reference numeral twenty-six. U.S. Pat. No. 6,645,011 is hereby incorporated herein by reference.

Accordingly, there is a need for a way to interconnect two coaxial connectors so that components of the structure performing the act of connecting do not become over stressed or plastically deform and that the components of the connecting structure do not impart signal noise when the mated connectors become misaligned due to the application of external forces.

SUMMARY OF THE INVENTION

It is an object of the invention to provide a device which does not become over stressed or become plastically deformed when the device is subject to external forces.

It is another object of the invention to provide a device which can withstand some amount of misalignment, when it is subjected to external forces, and not produce a significant amount of signal noise.

It is still yet another object of the invention to provide a device which occupies a small amount of space.

In one form of the invention the device includes a plurality of beam tines. Each beam tine includes a lever tine. An adjacent pair of beam tines is separated by a slot where the slot has a root. A first distance is defined from the root to an edge of the beam tine. A second length is defined from the root to a distal end of the lever tine. The first length is greater than the second length.

In another form of the invention the device includes a coupling spring and a sliding sleeve. The coupling spring includes a plurality of beam tines. Each beam tine includes a lever tine. An adjacent pair of beam tines is separated by a slot where the slot has a root. A first distance is defined from the root to an edge of the beam tine. A second length is defined from the root to a distal end of the lever tine. The first length is greater than the second length. The sliding sleeve is slidably associated with the coupling spring.

In still yet another form of the invention the device includes an inner conductor, a dielectric material, an outer conductor, a coupling spring, and a sliding sleeve. The dielectric material surrounds the inner conductor. The outer conductor surrounds the dielectric material. The sliding sleeve is slidably attached to the outer conductor. The coupling spring is attached to the outer conductor. The coupling spring includes a plurality of beam tines. Each beam tine includes a lever tine. An adjacent pair of beam tines is separated by a slot where the slot has a root. A first distance is defined from the root to an edge of the beam tine. A second length is defined from the root to a distal end of the lever tine. The first length is greater than the second length.

Thus, the invention achieves the objectives set forth above. The invention provides a device which is able to withstand external forces and not become plastically deformed and not create a significant amount of signal noise, and the device is compact.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PRESENTLY PREFERRED EMBODIMENT

Figure 1:
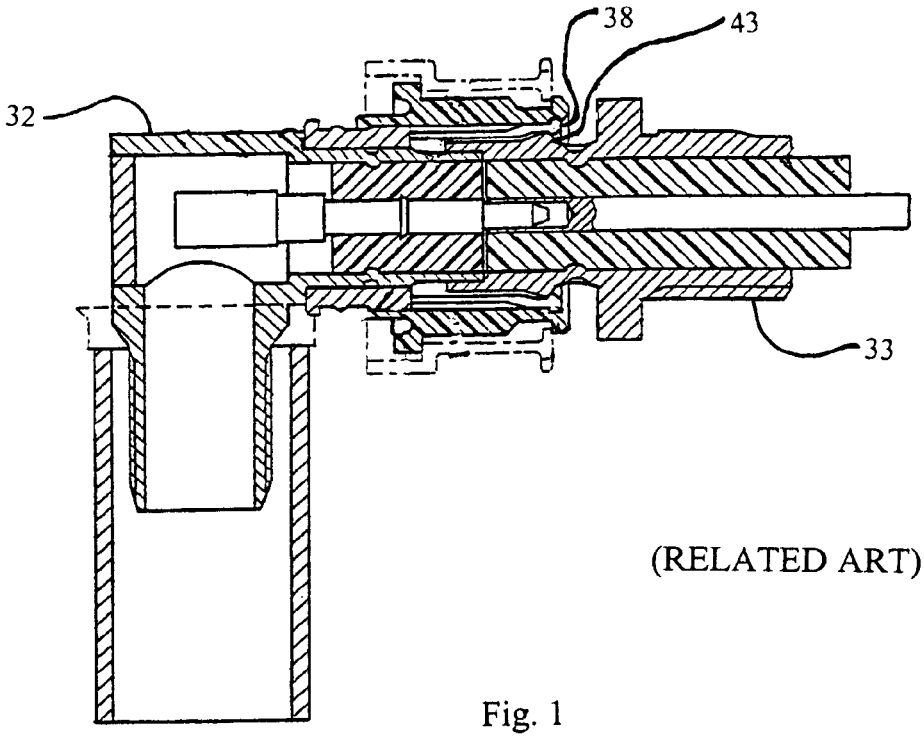
FIG. 1 is a cross-sectional side view of a first related art coaxial connector assembly.
Figure 2:
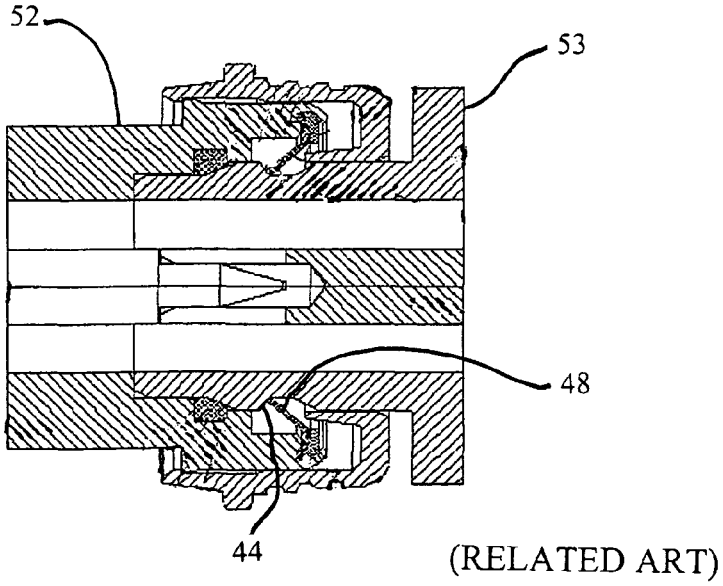
FIG. 2 is a cross-sectional side view of a second related art coaxial connector assembly.
Figure 3:
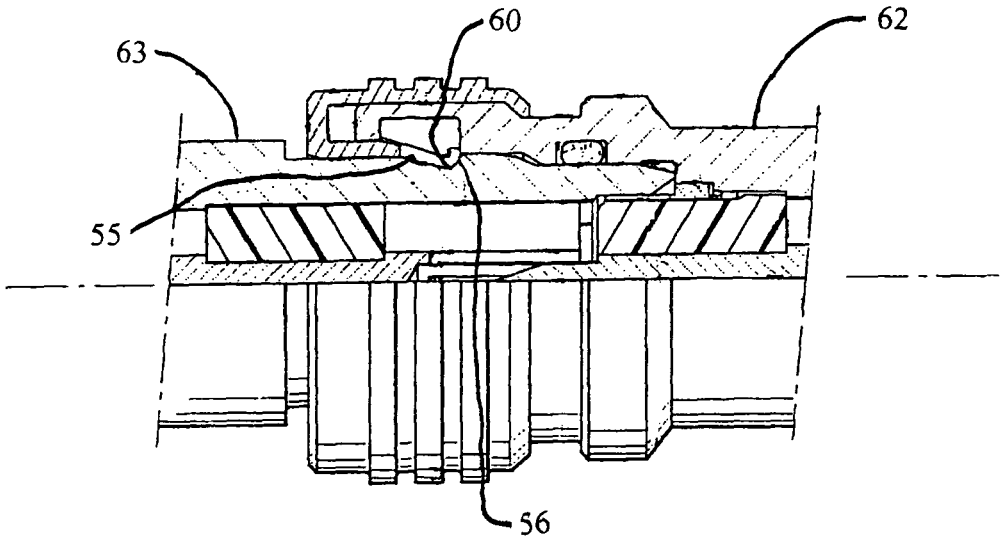
Fig. 3 (RELATED ART)
FIG. 3 is a partial cross-sectional side view of a third related art coaxial connector.

Referring now to FIGS. 4-7, wherein like reference numerals designate identical or corresponding parts through the several views, an embodiment of the present invention is displayed therein.

Figure 4:
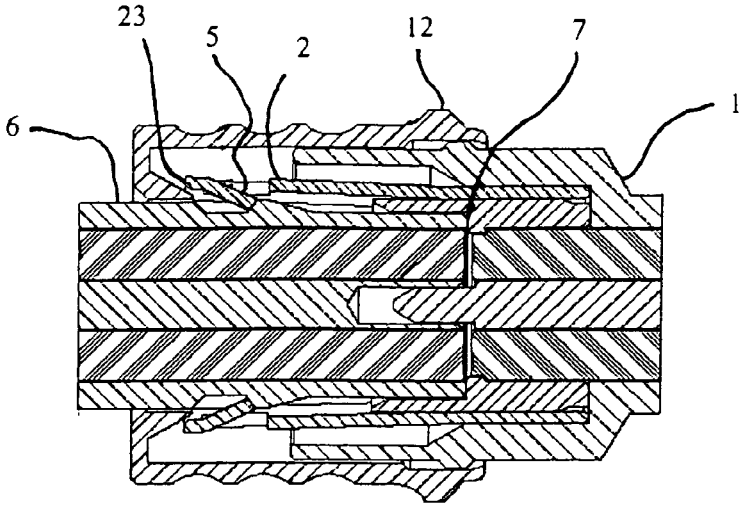
FIG. 4 is a cross-sectional side view of the coaxial connector of the invention shown connected to a mating connector.
Figure 5:
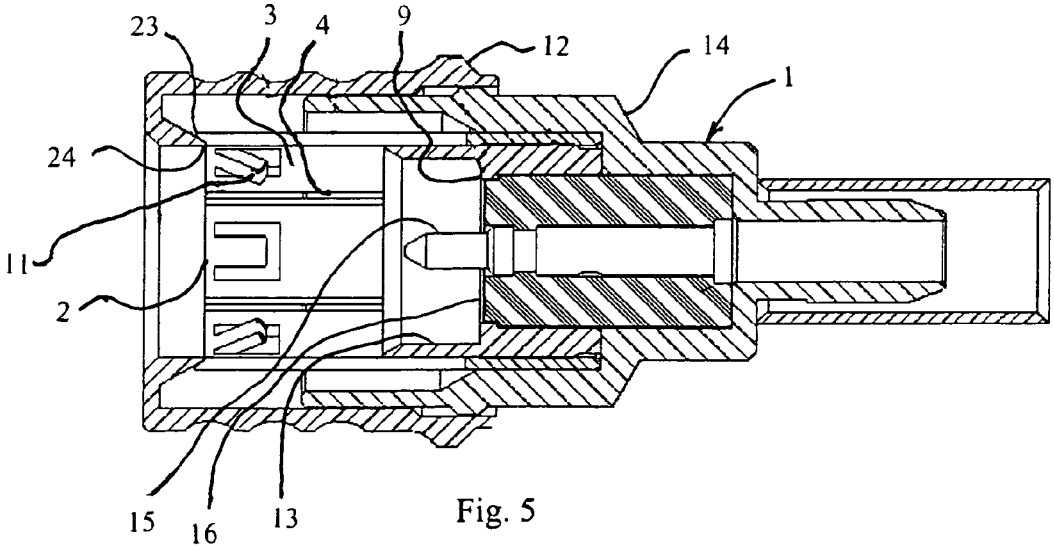
FIG. 5 is a partial cross-sectional view of the coaxial connector of the invention of FIG. 4.

FIG. 4 is a cross-sectional side view which shows a male coaxial connector or device 1 connected to a mating coaxial connector or female coaxial connector 6. FIG. 5 is a cross-sectional side view of the male coaxial connector 1. The male coaxial connector 1 includes two concentric electrically conductive paths created by an outer conductor, and an inner conductor or pin 15. The outer conductor is comprised by the combination of the front outer housing 13 and the rear outer housing 14. The inner conductor or pin 15 is suspended within the outer conductor by a dielectric material 16.

Figure 6:
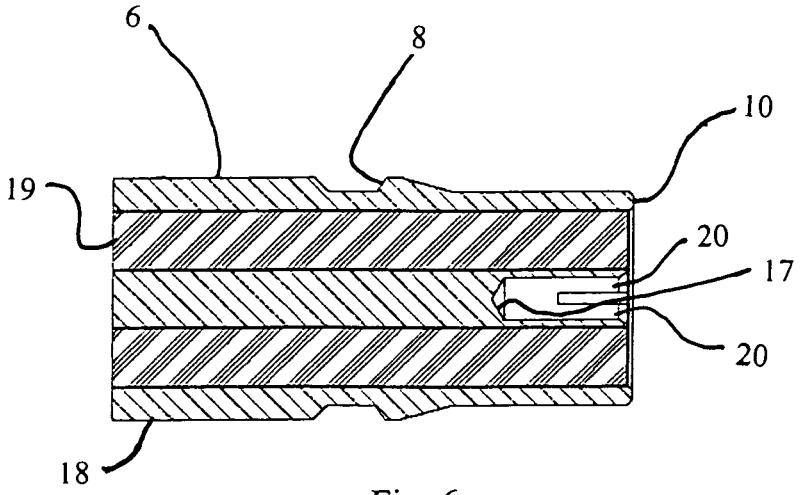
FIG. 6 is a cross-sectional side view of the mating connector of FIG. 4.

FIG. 6 is a cross-sectional side view of the mating connector or female coaxial connector 6. The female coaxial connector 6 includes an inner conductor 17, an outer conductor 18, and a dielectric material 19. The inner conductor 17 of the female coaxial 6 takes the form of a slotted socket having deformable portions 20.

When coaxial connector 1 is mated to coaxial connector 6, the inner conductor or pin 15 of coaxial connector 1 is mated to the inner conductor 17 of coaxial connector 6 and maintains good electrical contact via a pin or inner conductor 15 and slotted socket 17 configuration where the pin or inner conductor 15 of the one coaxial connector 1 deflects the deformable portions 20 of the slotted socket 17 of the mating coaxial connector 6 creating reactive normal forces onto the pin or inner conductor 15. This reactive force is essential for low contact resistance between pin or inner conductor 15 and socket 17 of the internal conductors of mating coaxial connector 1 and coaxial connector 6. A low contact resistance between outer conductors of coaxial connector 1 mated to coaxial connector 6 is also required for good electrical performance. The male coaxial connector 1 generates excellent normal coupling forces between the outer conductor, which is composed of the front outer housing 13 and the rear outer housing 14, of the male coaxial connector 1 and the outer conductor 18 of the female coaxial connector 6 as is described below.

Figure 7:
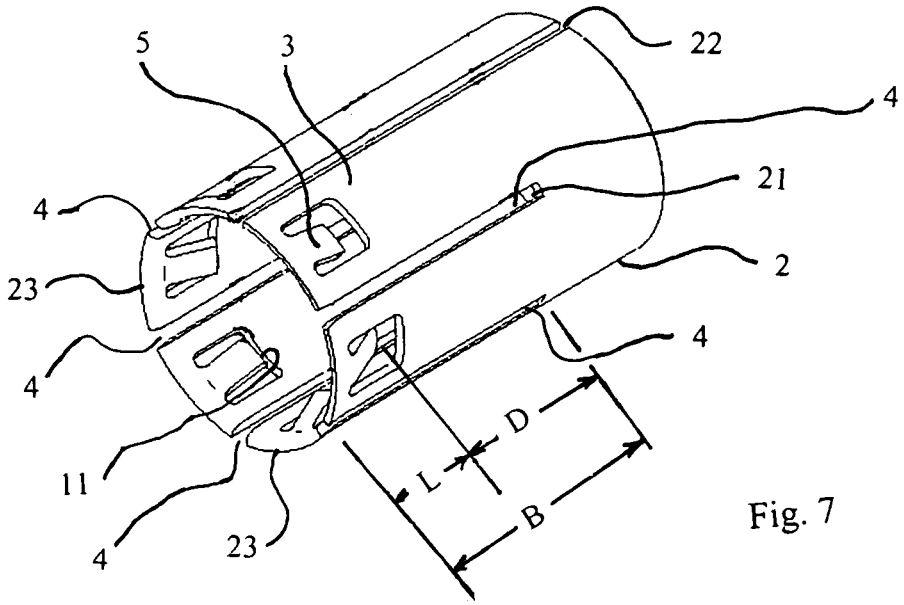
FIG. 7 is a perspective view of the coupling spring of the invention of FIGS. 4 and 5.

The male coaxial connector 1 includes a coupling spring 2 which can expand in the radial direction. The coupling spring 2 having a tubular shape. The coupling spring 2 is mounted between the front outer housing 13 and the rear outer housing 14 by way of a press fit. A perspective view of the coupling spring 2 is shown in FIG. 7. The coupling spring 2 includes one or more beam tines 3. Each beam tine 3 includes an aperture and a lever tine 5 at the end of the beam tine 3. A portion of the lever tine 5 exists in the aperture. The lever tine 5 extends inwardly from the aperture. The lever tine 5 extends back under the beam tine 3 which functionally adds effective tine length, the summation of beam tine length and lever tine length, to the spring without adding additional length to the connector package. The additional effective spring length provides resilience to misalignment between the mating connector 6 and the male coaxial connector 1, and out of round conditions of the mating connector 6. Such features extend the durability of the connector 1 and the mated connection between coaxial connector 1 and coaxial connector 6. If a tine were shorter, as in one of the related art examples, the shorter tine may be subject to permanent yield stress damage due to deflection that occurs during the mating of the two connectors.

When the male coaxial connector 1 is mated to the female coaxial connector 6, the lever tines 5 create an axial coupling force which tends to urge the male coaxial connector 1 toward the female coaxial connector 6. The beam tine 3 and the lever tine 5 are arranged in a linkage configuration to lever against an inclined plane 8 of the female coaxial connector 6. The spring linkage angularity converts the radial force of the coupling spring 2 into an axial coupling force between the mating connectors, coaxial connector 1 and coaxial connector 6, and very good electro-mechanical performance due to low contact resistance.

The linkage effect of the beam tine 3 and the lever tine 5 keep the lever tine 5 anchored on the inclined plane 8 of the mating connector 6 even if the connector mating planes separate slightly due to excessive environmental forces. The lever tine 5 initially swivels and is not forced to slide up the inclined plane 8 thus causing electrical signal noise between coaxial connector 1 and coaxial connector 6 due to varying contact resistance of a sliding contact point. The lever tine 5 can remain anchored at a near normal angle by static friction to the inclined plane 8. The lever tine 5 will first swivel as a linkage to the larger beam tine 3 before any sliding motion occurs between the lever tine 5 and the inclined plane 8. This is due to the near normal angle of the lever tine 5 with respect to the inclined plane 8 of the mating connector 6. The leverage effect and the linkage angle between the beam tine 3 and the lever tine 5 of the connector 1 creates a high normal force directly against the inclined plane 8 of the mating connector 6. The arrangement of the coupling spring 2 is such that it can absorb a small amount of separation between coaxial connector 1 and coaxial connector 6 without breaking electrical contact.

Beam tines 3 are defined by slots 4. Lever tines 5 are formed at the ends of the beam tines 3. The lever tine 5 is formed at a shallow angle to the beam tine 3 inward towards the axis of the connector 1. The lever tine 5 is located on the beam tine 3 such that the distal end 11 of the lever tine 5 shall fall upon the inclined plane 8 of the mating connector 6 when coaxial connector 1 is mated to coaxial connector 6. The shallow angle between the beam tine 3 and the lever tine 5 create a toggle style linkage that can act upon an inclined plane 8 of the mating connector 6 to generate an axial coupling force between coaxial connector 1 which is coupled to coaxial connector 6. The coupling force is generated by sliding the connector 1 onto and against the mating connector 6 until connector 1 butts up against connector 6 coincidental surfaces 7. This action causes the beam tines 3 of the connector 1 to expand away from the connector axis creating a reactive force amplitude that is relative or proportional to the deflection distance. The reactive force of the deflected beam tine 3 acts on the lever tine 5 which in turn acts against the inclined plane 8 of the mating connector 6. This coupling force causes the connector 1 and the mating connector 6 to stay coupled together so that associated surface 9 of coaxial connector butts up against associated surface 10 of coaxial connector 6. A radial surface 11 at the end of the lever tine 5 rests against the mating connector 6 and is a surface that assists the lever tine 5 to slide smoothly over the peak of the inclined plane 8 during coupling and decoupling actions.

A sliding sleeve 12 is slidably attached to the male coaxial connector 1. When the male coaxial connector 1 is mated to the mating connector 6, the sliding sleeve 12 is used to detach the male coaxial connector 1 from the mating connector 6. The sliding sleeve 12 has an edge 24 which is introduced to a location adjacent to the edge 23 of the coupling spring 2 when the sliding sleeve 12 is moved relative to the rear outer housing 14. The sliding sleeve 12 is then moved still further toward the coupling spring 2 so that the edge 24 of the sliding sleeve 12 engages the beam tines 3 of the coupling spring 2 so as to deflect the beam tines 3 in a direction away from the connector axis thus lifting the lever tines 5 up and over the inclined plane 8 allowing the connectors to be separated.

In FIG. 7, numeral designator 22 identifies a length-wise slot. The length-wise slot 22 need not be present. Instead, the coupling spring 2 could have a ring shape, so long as the slots 4 are present. During engagement and disengagement of coaxial connector 1 and coaxial connector 6, the beam tines 3 and the lever tines 5 are deflected and the width of the length-wise slot 22 is substantially unchanged. In its present form, the coupling spring 2 with the length-wise slot 22 makes itself amenable to being stamped and then rolled during the manufacturing of the coupling spring 2. The coupling spring 2 is preferably made of beryllium copper which is a conductive material and as such also acts as a backup outer conductor. FIG. 7 identifies a distance D which is the length from a root 21 of a slot 4 to the radial edge or distal end 11 of a lever tine 5, a distance B which is the length from the root 21 of the slot 4 to the edge 23 of end of the coupling spring 2 nearest the beam tine 3, and a distance L which is the length from the distal end 11 of the lever tine 5 to the edge 23 of the beam tine 5. The distance B is greater than the distance D. The distal end 11 of the lever tine 5 is located more radially inward or nearer the axis of symmetry of the coupling spring 2 than is the edge 23 of the beam tine 3.

Obviously, numerous modifications and variations of the present invention are possible in light of the above teachings. It is therefore to be understood that within the scope of appended claims, the invention may be practiced otherwise than as specifically described herein.

The invention claimed is:

1. An electrical connector device comprising:

a tubular coupling spring having a plurality of beam tines, and wherein each beam tine includes an aperture and a lever tine, a portion of the lever tine existing and extending inwardly from the aperture, and wherein an adjacent pair of beam tines is separated by a slot where the slot includes a root, and wherein a first length is defined from the root to an end of the coupling spring nearest the beam tine, a second length is defined from the root to a distal end of the lever tine, and wherein the first length is greater than the second length, and wherein the distal end of the lever tine is more near an axis of symmetry of the coupling spring than is the end of the coupling spring; and a sliding sleeve having an extending inward edge associated with the coupling spring, where the sliding sleeve can slide relative to the coupling spring.

2. The electrical connector device according to claim 1 wherein the extending inward edge of the sliding sleeve is more near the axis of symmetry of the coupling spring than is the end of the coupling spring nearest the beam tine.

3. The electrical connector device according to claim 2 wherein, when the sliding sleeve is slid towards the coupling sleeve, the extending inward edge of the sliding sleeve engages a location adjacent to the end of the coupling spring, and wherein, when the sliding sleeve is still further slid toward the coupling spring, the extending inward edge of the sliding sleeve engages the beam tines of the coupling spring so as to deflect the beam tines in a direction away from the axis of symmetry of the coupling spring.

4. The electrical connector device according to claim 3 wherein the coupling spring is made of beryllium copper.

5. An electrical connector device comprising:

an inner conductor;

a dielectric material surrounding the inner conductor;

an outer conductor surrounding the dielectric material;

a tubular coupling spring attached to the outer conductor, the coupling spring having a plurality of beam tines, and wherein each beam tine includes an aperture and a lever tine, a portion of the lever tine existing and extending inwardly from the aperture, and wherein an adjacent pair of beam tines is separated by a slot where the slot includes a root, and wherein a first length is defined from the root to an end of the coupling spring nearest the beam tine, a second length is defined from the root to a distal end of the lever tine, and wherein the first length is greater than the second length, and wherein the distal end of the lever tine is more near an axis of symmetry of the coupling spring than is the end of the coupling spring; and a sliding sleeve slidably attached to the outer conductor, the sliding sleeve includes an extending inward edge associated with the coupling spring.

6. The electrical connector device according to claim 5 wherein the outer conductor includes a front outer housing and a rear outer housing.

7. The electrical connector device according to claim 6 wherein the coupling spring is attached to the outer conductor by a press fit between the front outer housing and the rear outer housing.

8. The electrical connector device according to claim 7 wherein the sliding sleeve is attached to the outer conductor by being slidably attached to the rear outer housing of the outer conductor.

9. The electrical connector device according to claim 8 wherein the coupling spring is made of beryllium copper.

10. The electrical connector device according to claim 9 wherein the extending inward edge of the sliding sleeve is more near the axis of symmetry of the coupling spring than is the end of the coupling spring nearest the beam tine.

* * * * *